US012680446B1

(12) United States Patent
Ghaffar et al.

(10) Patent No.: US 12,680,446 B1
(45) Date of Patent: Jul. 14, 2026

(54) DETECTING WELLBORE LEAKS

(71) Applicant: Saudi Arabian Oil Company, Dhahran (SA)

(72) Inventors: Ahmed Ghaffar, Dhahran (SA); Omar M. Al Hamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/018,398

(22) Filed: Jan. 13, 2025

(51) Int. Cl.
*E21B 47/117* (2012.01)
*E21B 47/07* (2012.01)

(52) U.S. Cl.
CPC ..... *E21B 47/117* (2020.05); *E21B 47/07* (2020.05)

(58) Field of Classification Search
CPC ..... E21B 47/117; E21B 47/07
USPC ..... 166/250.08
See application file for complete search history.

(56) References Cited

U.S. PATENT DOCUMENTS

| | | | | |
|---|---|---|---|---|
| 7,109,717 | B2 | 9/2006 | Constable | |
| 7,584,081 | B2 | 9/2009 | Wen et al. | |
| 11,913,329 | B1 * | 2/2024 | Zeghlache | E21B 47/26 |
| 2017/0350234 | A1 * | 12/2017 | Xia | E21B 47/10 |
| 2019/0211669 | A1 * | 7/2019 | McMillon | G01M 3/24 |
| 2020/0131899 | A1 * | 4/2020 | Chen | E21B 47/10 |
| 2021/0140311 | A1 * | 5/2021 | Deffenbaugh | E21B 47/06 |
| 2022/0282615 | A1 * | 9/2022 | Alghazali | E21B 47/117 |
| 2023/0203901 | A1 * | 6/2023 | Thomson | E21B 47/12 166/381 |

FOREIGN PATENT DOCUMENTS

AU 2016271165 B2 7/2019

* cited by examiner

*Primary Examiner* — Taras P Bemko
(74) *Attorney, Agent, or Firm* — Fish & Richardson P.C.

(57) ABSTRACT

A method of detecting leaks in a wellbore annulus includes deploying one or more sensors into an annulus defined between a wellbore string and a wall of a wellbore. The method also includes receiving, from the one or more sensors, sensor feedback including at least one of pressure information or temperature information of the annulus. The method also includes determining, as a function of the sensor feedback, a location of a fluid leak within the annulus.

20 Claims, 5 Drawing Sheets

DETECTING WELLBORE LEAKS

TECHNICAL FIELD

This disclosure relates to wellbore leaks.

BACKGROUND

Production wellbores include casing to support the wellbore and pipes to direct the production fluid to the surface of the wellbore. Wellbores have an annulus formed between two concentric tubulars within the wellbore. Such annuls is intended to remain fluidly isolated from parts of the tubulars. Detecting leaks at the annulus can be costly. Methods and equipment for detecting annulus leaks are sought.

SUMMARY

Implementations of the present disclosure include a method of detecting leaks in a wellbore annulus. The method includes deploying one or more sensors into an annulus defined between a wellbore string and a wall of a wellbore. The method also includes receiving, from the one or more sensors, sensor feedback including at least one of pressure information or temperature information of the annulus. The method also includes determining, as a function of the sensor feedback, a location of a fluid leak within the annulus.

In some implementations, the method further includes, before determining the location of the fluid leak, determining a change in pressure of the fluid, determining a location of the change in pressure of the fluid, and comparing the change in pressure to a threshold. Determining the location of the fluid leak includes determining, as a function of determining that the change in pressure satisfies the threshold, the location of the fluid leak. In some implementations, the receiving includes receiving pressure values associated with timestamps, and determining the location of the change in pressure includes determining, as a function of a time at which the one or more sensors were deployed, a falling speed of the one or more sensors, and the timestamps, a depth of the change in pressure.

In some implementations, deploying the one or more sensors includes delivering the one or more sensors into the annulus through a lubricator residing at a terranean surface of the wellbore.

In some implementations, the lubricator is part of a wellhead fluidly coupled to the wellbore string, and the lubricator is coupled to at least one of a tubing head spool or a casing spool of the wellhead.

In some implementations, the one or more sensors includes a pressure sensor and a temperature sensor disposed within a housing of a microbead. The microbead further includes a microchip electrically coupled to the pressure sensor and temperature sensor. The deploying the one or more sensors includes deploying one or more microbeads, and receiving the sensor feedback includes receiving, from the microchip, pressure information and temperature information gathered by the pressure sensor and temperature sensor. In some implementations, the determining includes determining, by the microchip, as a function of the sensor feedback, a falling speed of the microbead, and a time of deployment, the location of the fluid leak. In some implementations, microbead further includes a memory configured to store a log of pressure values and temperature values at different timestamps along the wellbore as the microbead falls within the annulus, and the determining includes determining, as a function of the pressure values and temperature values, the location of the fluid leak. In some implementations, the receiving includes continuously receiving pressure information or temperature information from the microchip as the microbead travels within an annulus fluid along the annuls in a downhole direction. In some implementations, the microbead includes a weight compartment, the method further including, before deploying the microbead, selecting, as a function of a density of an annulus fluid, a number of weights to be within the weight compartment to adjust a weight of the microbead to allow the microbead to descend along the annulus at a predetermined speed. In some implementations, the method further includes, before deploying the microbead, adjusting, as a function of a density of the fluid, a weight of the microbead to allow microbead to descend along the annulus at a speed of between 5 and 15 meters per second.

In some implementations, receiving the sensor feedback includes receiving sensor feedback continuously or at time intervals as the one or more sensors descend within the annulus.

In some implementations, the method further includes, before deploying the one or more sensors, pre-installing the one or more sensors within a wellhead, and the deploying includes deploying the one or more sensors using a lubricator attached to the wellhead.

In some implementations, the wellbore string includes an aperture through which fluid leaks into or out of the wellbore string, and determining the location of the fluid leak includes detect a location of the aperture.

Implementations of the present disclosure include a method of detecting a leak in a wellbore casing. The method includes receiving, by a system including one or more computers in one or more locations, sensor feedback from one or more sensors. The sensor feedback includes at least one parameter of an annulus defined between an external surface of a wellbore string and a wall of a wellbore. The parameter is gathered while the one or more sensors fall downhole within the annulus. The method also includes determining, by the system and as a function of (i) the sensor feedback and (ii) a falling speed of the one or more sensors, a location of a fluid leak within the annuls.

In some implementations, the method further includes, after the determining, providing, by the system and to a receiver, the location of the fluid leak.

In some implementations, the determining includes comparing, by the system, the parameter to at least one threshold, and also determining, by the system and as a function of the comparison, that the parameter satisfies the at least one threshold.

In some implementations, the method further includes, before determining the location of the fluid leak, determining a change in pressure of the fluid, determining a location of the change in pressure of the fluid, and comparing the change in pressure to a threshold. Determining the location of the fluid leak includes determining, as a function of determining that the change in pressure satisfies the threshold, the location of the fluid leak.

Implementations of the present disclosure include a leak detection system. The leak detection system includes one or more hardware processors and a computer storage medium communicatively coupled to the one or more hardware processors. The computer storage medium includes instructions that, when executed by the one or more hardware processors, cause the one or more hardware processors to perform operations including receiving, from one or more sensors, sensor feedback including at least one of pressure information or temperature information of an annulus defined between an outer surface of a wellbore string and a wall of the wellbore. The operations also include determining, as a function of the sensor feedback, a location of a fluid leak within the annulus.

In some implementations, the system further including a microbead including the one or more sensors. The microbead includes a microchip electrically coupled to the one or more sensors. The receiving the sensor feedback includes receiving, from the microchip, pressure information of the annulus and temperature information of the annulus gathered by the one or more sensors as the microchips falls within the annulus.

Particular implementations of the subject matter described in this specification can be implemented so as to realize one or more of the following advantages. For example, the leak detection system of the present disclosure allows the detection of wellbore leaks without expensive workover operations. Additionally, the leak detection system can also detect leaks faster than current methods, which can save time and resources.

DETAILED DESCRIPTION OF THE DISCLOSURE

Figure 1:
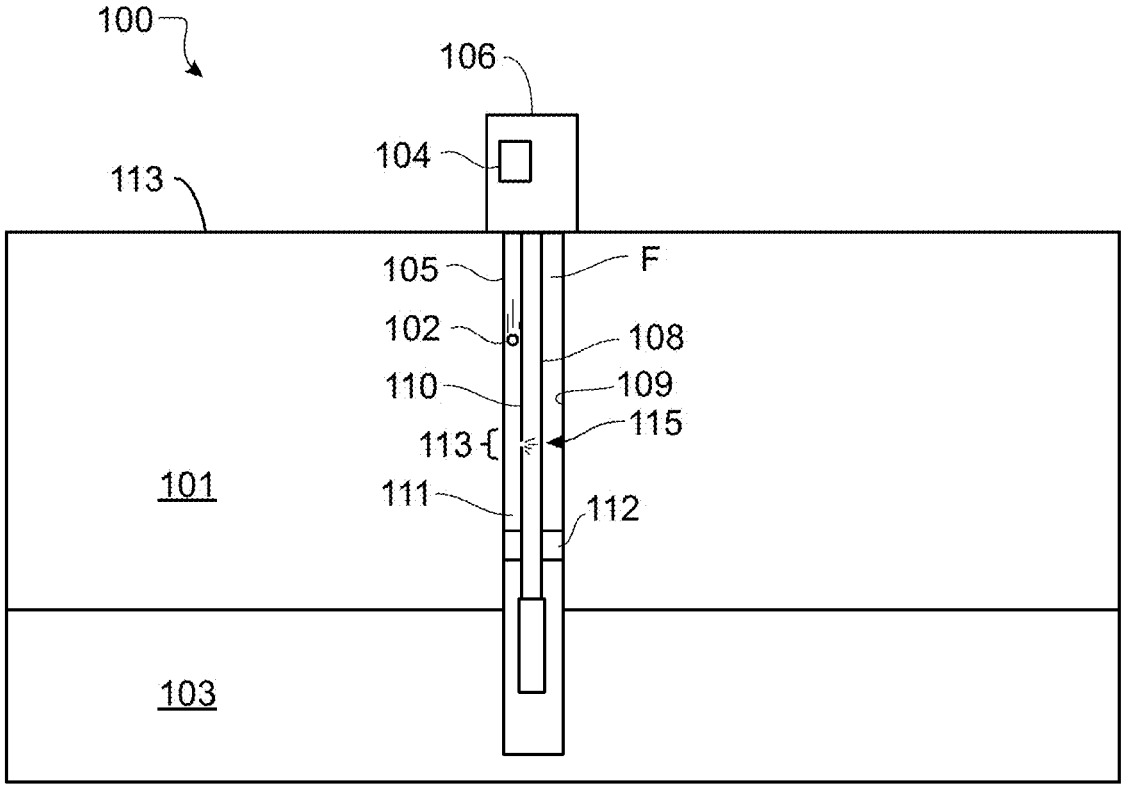
FIG. 1 shows a front schematic view, partially cross-sectional, of an example leak detection system.

FIG. 1 shows a system 100 (e.g., an annulus leak detection system or assembly) implemented in a wellbore 105. The wellbore 105 extends through a subterranean zone that includes a geologic formation 101. For example, the wellbore 105 extends down from a surface 113 (e.g., a terranean surface) of the wellbore 105 and is formed in the geologic formation 101. The geologic formation 101 can include one or more hydrocarbon reservoirs 103 from which hydrocarbons can be extracted.

The system 100 includes a wellbore string 110 (e.g., a production string, a casing, etc.), one or more sensor assemblies (e.g., microbeads 102), and surface equipment 104 (e.g., a receiver, controller, or one or more computers) that received information from the one or more microbeads 102. An external surface 108 of the wellbore string 110 forms, with a wall 109 of the wellbore 105, an annulus 111. The annulus 111 can extend, for example, from the surface 113 to the bottom of the well or to a packer 112 such as a production packer. The annulus can be, for example, a tubing casing annulus (TCA) or a casing-to-casing annulus (CCA). For example, if the annulus 111 is a TCA, the wellbore string 110 can be a production string or a drill string, and the wall of the wellbore can be the wall of the wellbore casing. However, if the annulus 111 is a CCA, the wellbore string 110 can be a first wellbore casing and the wall of the wellbore can be the wall of a second wellbore casing.

The system 100 detects a location 117 of leaks 115 at the annulus 111. For example, the wellbore string 110 can have an aperture or crack that allows fluid "F" to move, through the aperture or crack, between the wellbore string 110 and the annulus 111. Depending on the pressure differential between the wellbore string 110 and annulus 111, the fluid "F" leaks into the wellbore string 110 from the annulus 111 or out of the wellbore string 110 into the annulus 111.

Each microbead 102 detects parameters of the annulus 111 to determine a location of the leak 115. For example, the microbead 102 detects a change in pressure at the annulus 111 that indicates that there is a leak 115 in the annulus 111. The microbead 102 or another device also determines the location 117 of the leak 115 based on the release time of the microbead 102, the falling speed of the microbead 102, and the change in pressure at the annulus 111. The microbead 102 can sense the changes in pressure at the annulus 111 as the microbead 102 moves (e.g. falls) within the annulus. In other words, the microbead 102 is sized and arranged to be deployed within the annulus 111 and continuously sense the pressure within the annulus 111 to determine where there is a change in pressure that indicates the potential of a leak 115.

In some aspects, the surface equipment 104 is part of a wellhead 106 that is attached to the wellbore string 110. The surface equipment is communicatively coupled with the microbead 102. The calculations to determine the location of the fluid leak 115 can be performed by the surface equipment 104, the microbead 102, or a combination of the two. The surface equipment 104 can include a controller that, for example, controls valves or pumps to regulate, based on determining the location of the leak, a fluid flow within the wellbore. For example, the controller can close the wellbore upon determining that the wellbore has a leak.

As further described in detail below with respect to FIGS. 2 and 3, the microbead 102 has sensors, a microchip with a hardware processor, and a computer storage medium communicatively coupled to the hardware processor. The computer storage medium has instructions that, when executed by the hardware processor, cause the hardware processor to perform operations that include receiving, the sensors, sensor feedback that includes pressure information and temperature information of the annulus 111, and then determining, as a function of the sensor feedback, a location of a fluid leak 115.

To determine the location of the fluid leak, the processor can first determine a change in the pressure of the fluid, then determine if such change in pressure satisfies a threshold (e.g., a threshold indicative of a fluid leak), and then determine the location of such change in pressure. For example, the microbead 102 can sense the pressure of the fluid "F" in the annulus 111 continuously (or in intervals) as the microbead 102 falls downhole within the annulus 111. The pressure values that the sensors of the microbead 102 send to the processor are associated with timestamps. If the measured pressure at a given time while the microbead 102 descends within the annulus 111 changes (e.g., dops) at or below a certain threshold, the microbead 102 determines that such a change in pressure is associated with a leak. The microbead 102 then determines the time (e.g., pressure values associated with a timestamp) at which the change in pressure was detected and calculates, as a function of (i) the falling speed of the microbead 102, (ii) the time at which the pressure change was detected, and (iii) the time at which the microbead 102 was deployed from the surface, the location (e.g., the depth) of the change in pressure, and thus the location of the leak 115.

In some aspects, the microbead 102 determines the location 117 of the leak 115 in or near real time and transmits the location information to the surface equipment 104 in or near real time. As used herein, the term "real-time" refers to transmitting or processing data without intentional delay given the processing limitations of a system, the time required to accurately obtain data, and the rate of change of the data. Although there may be some actual delays, the delays are generally imperceptible to a user. For example, the duration between receiving an input and processing the input to provide an output can be minimal, for example, in the order of seconds, milliseconds, microseconds, or nanoseconds.

Figure 2:
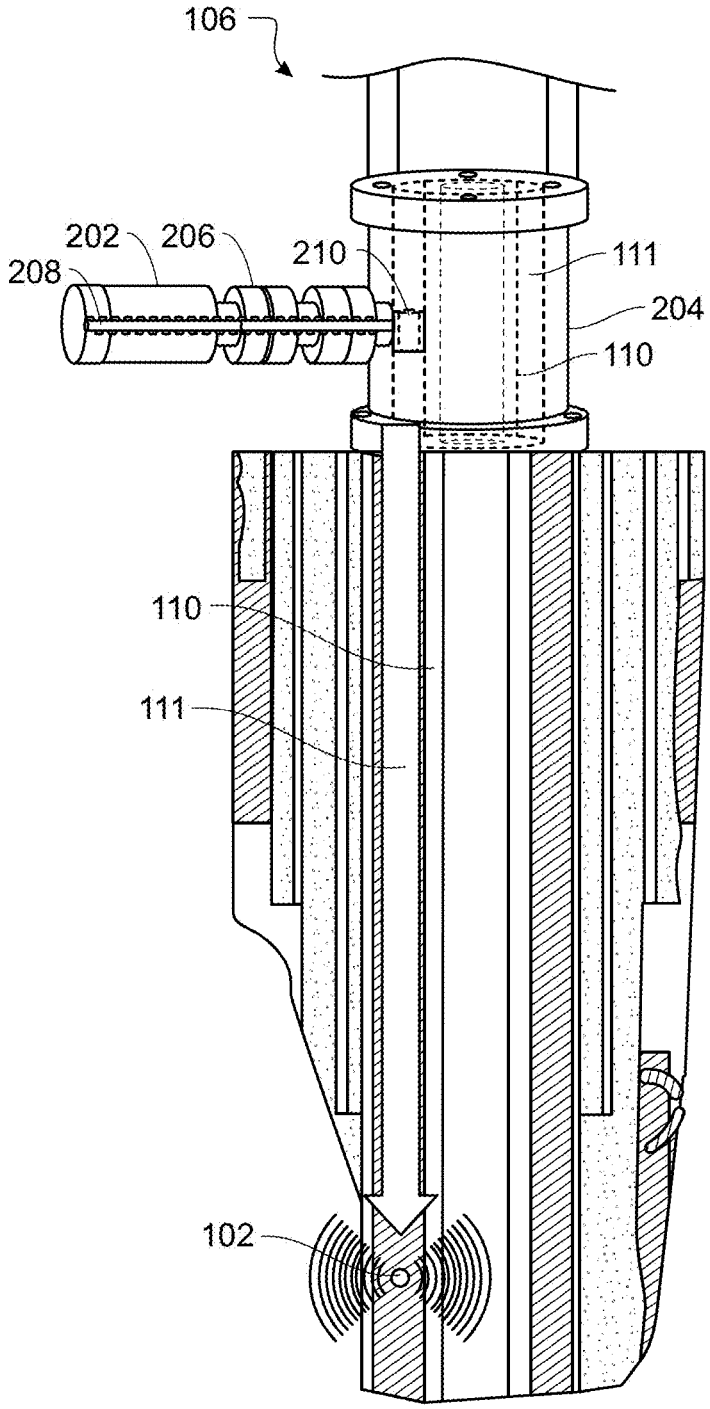
FIG. 2 shows a front schematic view, partially cross-sectional, of a portion of the leak detection system.

FIG. 2 shows a surface assembly 106 (e.g., a wellhead 106) used to deploy the microbeads 102. The wellhead 106 includes a lubricator assembly 202 which is coupled to a wellhead component 204 such as a tubing head spool or a casing spool of the wellhead 106. In some aspects, the lubricator is a high-pressure control equipment with a pressure rating of, for example, 3,000 or 5,000 pounds per square inch (psi). The lubricator assembly 202 is connected to the side outlet of tubing head spool 204 through a flange 206 (e.g., a 2 1/16-inch flange-to-flange connection). The annulus 111 extends into the wellhead component 204 so that the microbead 102 can be deployed into the annulus 11 from the lubricator 202.

The lubricator 202 includes a dropper tool 208 that allows the microbead 102 to be dropped within the annulus 111 from the lubricator 202. The dropper tool 208 can be, for example, a rod with an engagement end 210 that engages the microbead 102 to insert the microbead through the lubricator 202 until the microbead 102 reaches the annulus 111. At the annulus, the rod can be rotated or otherwise manipulated to disengage the microbead 102 and thus deploy the microbead 102. In some aspects, the dropper tool 208 includes a valve or a gate that opens to drop the pre-installed microbead 102. For example, the microbead 102 can be pre-installed within the tubing head spool before installing the lubricator, and the tool 208 of the lubricator can be used, after installing the lubricator, to release the microbead 102. In some aspects, the dropper tool 208 includes a rod that pushes the microbead 102 from the lubricator 202 into the annuls 111.

To install the lubricator 202 on the tubing head spool 204, first the lubricator 202 is connected (e.g., bolted into) to the tubing head spool 204. After the connection is made, the lubricator 202 is tested to the required pressure against the closed gate valve of the tubing head spool side outlet and connection integrity is confirmed. After the successful pressure test, the gate valve of the tubing casing annulus 111 is opened and pressure is allowed to equalize. Once equalized, the microbead 102 is dropped into the annulus 111 with the dropper tool 208.

Figure 3:
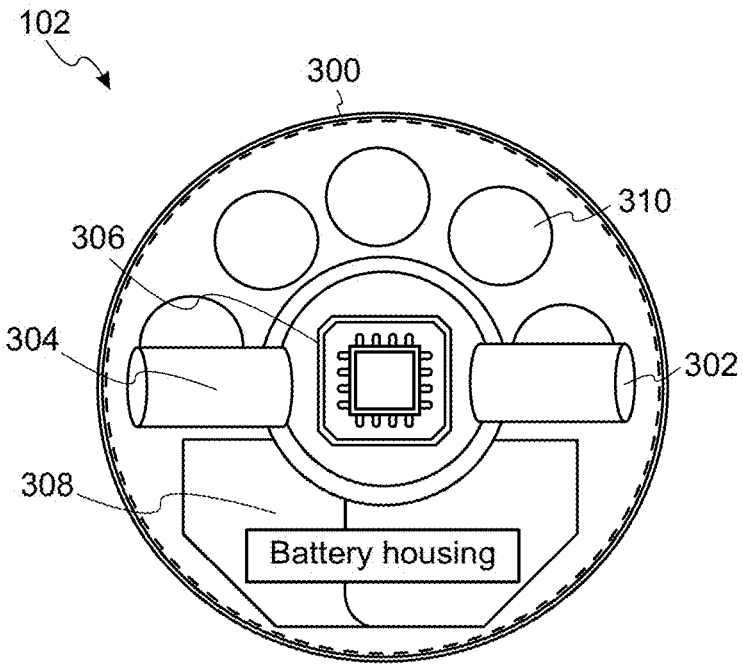
FIGS. 3-4 top and side schematic views, respectively of a microbead.
Figure 4:
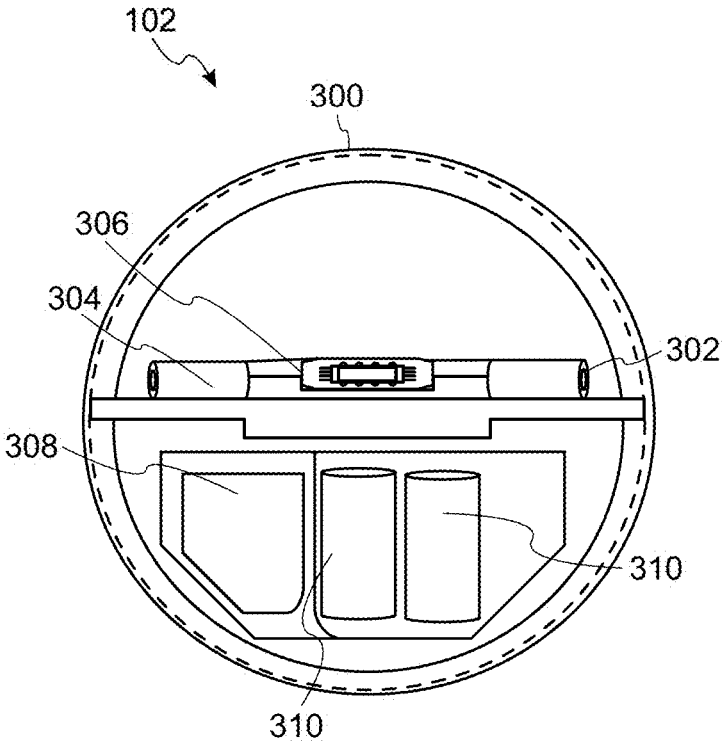

FIGS. 3 and 4 show top and side views, respectively, of an example microbead 102 according to implementations of the present disclosure. The microbead 102 includes a housing 300 or casing, and multiple components 302, 304, 306, 308, 310 disposed within the housing 300. The components include a pressure sensor 302, a temperature sensor 304, a microchip 306, a battery 308, and one or more weights 310.

The microchip 306 is electrically coupled to the pressure sensor 302, the temperature sensor 304, and the battery 308. The microchip 306 receives the sensor feedback from the sensors 302, 304 and can either send the information to the surface or can determine, as a function of the sensor feedback and a pre-determined speed of the microbead 102, all or part of the location of the leak. As further described in detail below with respect to FIG. 5, the microchip 306 can include a computer storage medium (e.g., a memory) that stores or logs the pressure values and temperature values at different times (e.g. pressure values associated with timestamps) along the wellbore as the microbead 102 falls within the annulus. The memory can also include instructions that, when executed by a processor of the microchip 306, cause the processor of the microchip 306 to determine, as a function of the pressure values and temperature values, the location of the fluid leak.

The microchip 306 can continuously receive pressure information and temperature information from the sensors and determine, as the microbead 102 travels within the annulus fluid, the location of the fluid leak. In some aspects, the microchip 306 can continuously send the sensor information to the surface equipment as the microbead 102 falls within the annulus fluid.

The microbead 102 has weights 310 in a weight compartment of the housing 300. The weights 310 can reside within a weight compartment of the housing 300. The descending speed of the microbead 102 can be changed by changing the weight of the microbead 102. Thus, the desired descending speed of the microbead 102 can be controlled by controlling the number of weights 310 to place inside the microbead 102. The speed of the microbead 102 within the annulus can be determined as a function of the density of an annulus fluid and the weight of the microbead 102. The weight of the microbead 102 can be determined as a function of the number of weights 310 within the microbead 102. For example, for a set speed of the microbead, the denser the fluid, the larger the weight of the microbead 102 has to be. In some aspects, the number of weights 310 are selected to allow the microbead 102 to descend along the annulus at a falling speed of between 5 and 15 meters per second (e.g., 10 meters per second). With the speed of the microbead 102 predetermined, the distance traveled of the microbead 102 can be easily determined to establish the location of the fluid leak.

Figure 5:
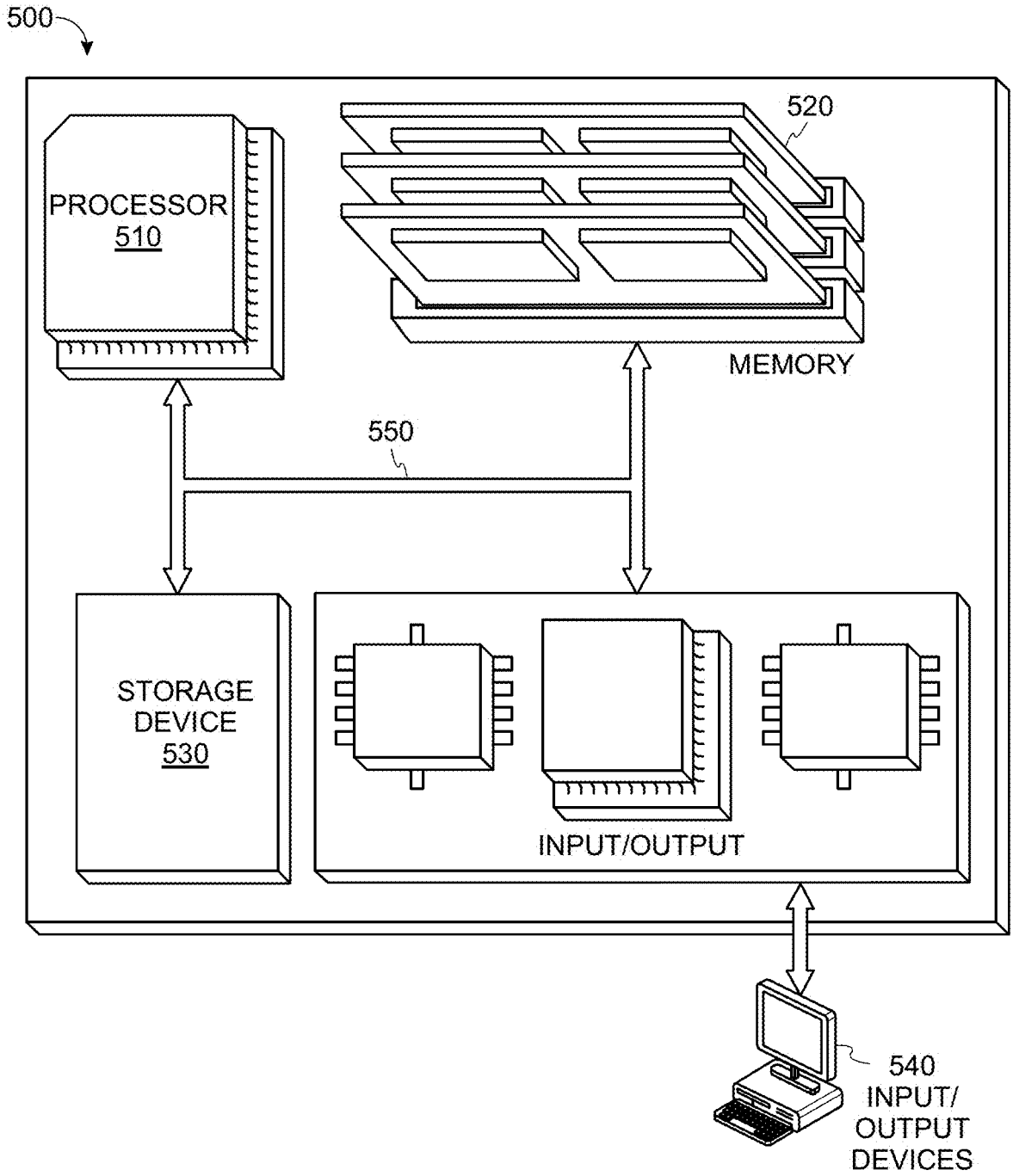
FIG. 5 shows a schematic illustration of an example control system of the leak detection system.

FIG. 5 is a schematic illustration of an example control system 500 or controller for a leak detection system according to the present disclosure. For example, the controller 500 may include or be part of the surface equipment shown in FIG. 1 or be part of the microchip in the microbead 102. The controller 500 is intended to include various forms of digital computers, such as printed circuit boards (PCB), processors, digital circuitry, or otherwise. Additionally, the system can include portable storage media, such as Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 500 includes a processor 510, a memory 520, a storage device 530, and an input/output device 540. Each of the components 510, 520, 530, and 540 are interconnected using a system bus 550. The processor 510 is capable of processing instructions for execution within the controller 500. The processor may be designed using any of a number of architectures. For example, the processor 510 may be a CISC (Complex Instruction Set Computers) processor, a RISC (Reduced Instruction Set Computer) processor, or a MISC (Minimal Instruction Set Computer) processor.

In one implementation, the processor 510 is a single-threaded processor. In another implementation, the processor 510 is a multi-threaded processor. The processor 510 is capable of processing instructions stored in the memory 520 or on the storage device 530 to display graphical information for a user interface on the input/output device 540.

The memory 520 stores information within the controller 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the controller 500. In one implementation, the storage device 530 is a computer-readable medium. In various different implementations, the storage device 530 may be a floppy disk device, a hard disk device, an optical disk device, or a tape device.

The input/output device 540 provides input/output operations for the controller 500. In one implementation, the input/output device 540 includes a keyboard and/or pointing device. In another implementation, the input/output device 540 includes a display unit for displaying graphical user interfaces.

Figure 6:
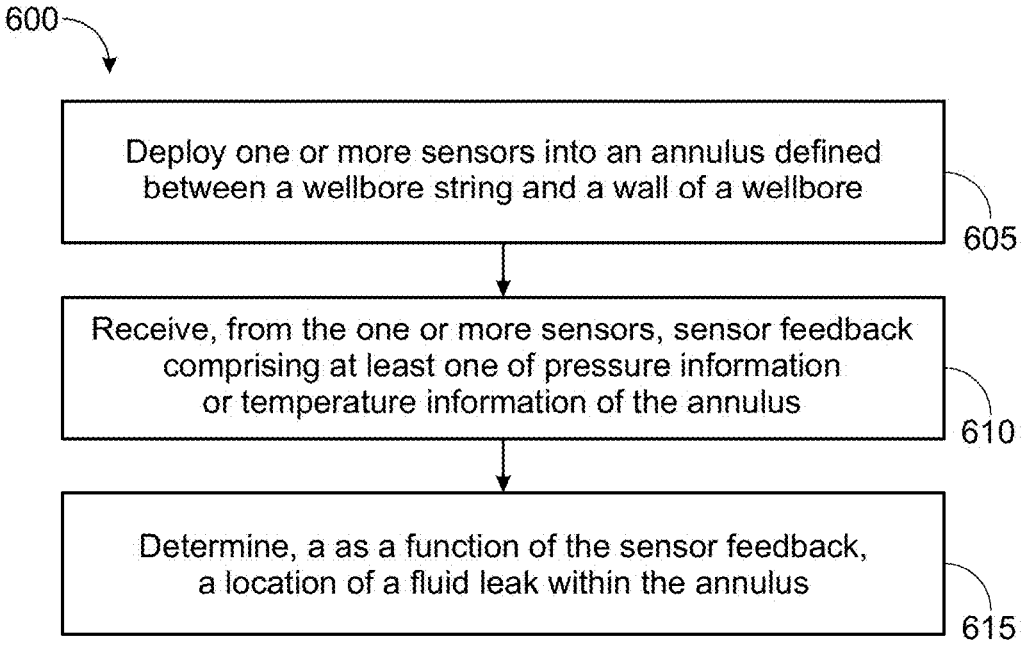
FIG. 6 shows a flow chart of an example method of detecting a leak.

FIG. 6 shows a flow chart of an example method 600 of detecting a leak in an annulus. The method includes deploying one or more sensors into an annulus defined between a wellbore string and a wall of a wellbore (605). The method also includes receiving, from the one or more sensors, sensor feedback comprising at least one of pressure information or temperature information of the annulus (610). The method also includes determining, as a function of the sensor feedback, the location of a fluid leak within the annulus (615).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, a method of detecting leaks in a wellbore annulus includes deploying one or more sensors into an annulus defined between a wellbore string and a wall of a wellbore. The method also includes receiving, from the one or more sensors, sensor feedback including at least one of pressure information or temperature information of the annulus. The method also includes determining, as a function of the sensor feedback, a location of a fluid leak within the annulus.

In an example implementation combinable with any other example implementation, the method further includes, before determining the location of the fluid leak, determining a change in pressure of the fluid, determining a location of the change in pressure of the fluid, and comparing the change in pressure to a threshold. Determining the location of the fluid leak includes determining, as a function of determining that the change in pressure satisfies the threshold, the location of the fluid leak. In an example implementation combinable with any other example implementation, the receiving includes receiving pressure values associated with timestamps, and determining the location of the change in pressure includes determining, as a function of a time at which the one or more sensors were deployed, a falling speed of the one or more sensors, and the timestamps, a depth of the change in pressure.

In an example implementation combinable with any other example implementation, deploying the one or more sensors includes delivering the one or more sensors into the annulus through a lubricator residing at a terranean surface of the wellbore.

In an example implementation combinable with any other example implementation, the lubricator is part of a wellhead fluidly coupled to the wellbore string, and the lubricator is coupled to at least one of a tubing head spool or a casing spool of the wellhead.

In an example implementation combinable with any other example implementation, the one or more sensors includes a pressure sensor and a temperature sensor disposed within a housing of a microbead. The microbead further includes a microchip electrically coupled to the pressure sensor and temperature sensor. The deploying the one or more sensors includes deploying one or more microbeads, and receiving the sensor feedback includes receiving, from the microchip, pressure information and temperature information gathered by the pressure sensor and temperature sensor. In an example implementation combinable with any other example implementation, the determining includes determining, by the microchip, as a function of the sensor feedback, a falling speed of the microbead, and a time of deployment, the location of the fluid leak. In an example implementation combinable with any other example implementation, microbead further includes a memory configured to store a log of pressure values and temperature values at different timestamps along the wellbore as the microbead falls within the annulus, and the determining includes determining, as a function of the pressure values and temperature values, the location of the fluid leak. In an example implementation combinable with any other example implementation, the receiving includes continuously receiving pressure information or temperature information from the microchip as the microbead travels within an annulus fluid along the annuls in a downhole direction. In an example implementation combinable with any other example implementation, the microbead includes a weight compartment, the method further including, before deploying the microbead, selecting, as a function of a density of an annulus fluid, a number of weights to be within the weight compartment to adjust a weight of the microbead to allow the microbead to descend along the annulus at a predetermined speed. In an example implementation combinable with any other example implementation, the method further includes, before deploying the microbead, adjusting, as a function of a density of the fluid, a weight of the microbead to allow microbead to descend along the annulus at a speed of between 5 and 15 meters per second.

In an example implementation combinable with any other example implementation, receiving the sensor feedback includes receiving sensor feedback continuously or at time intervals as the one or more sensors descend within the annulus.

In an example implementation combinable with any other example implementation, the method further includes, before deploying the one or more sensors, pre-installing the one or more sensors within a wellhead, and the deploying includes deploying the one or more sensors using a lubricator attached to the wellhead.

In an example implementation combinable with any other example implementation, the wellbore string includes an aperture through which fluid leaks into or out of the wellbore string, and determining the location of the fluid leak includes detect a location of the aperture.

In an example implementation, a method of detecting a leak in a wellbore casing includes receiving, by a system including one or more computers in one or more locations, sensor feedback from one or more sensors. The sensor feedback includes at least one parameter of an annulus defined between an external surface of a wellbore string and a wall of a wellbore. The parameter is gathered while the one or more sensors fall downhole within the annulus. The method also includes determining, by the system and as a function of (i) the sensor feedback and (ii) a falling speed of the one or more sensors, a location of a fluid leak within the annuls.

In an example implementation combinable with any other example implementation, the method further includes, after the determining, providing, by the system and to a receiver, the location of the fluid leak.

In an example implementation combinable with any other example implementation, the determining includes comparing, by the system, the parameter to at least one threshold, and also determining, by the system and as a function of the comparison, that the parameter satisfies the at least one threshold.

In an example implementation combinable with any other example implementation, the method further includes, before determining the location of the fluid leak, determining a change in pressure of the fluid, determining a location of the change in pressure of the fluid, and comparing the change in pressure to a threshold. Determining the location of the fluid leak includes determining, as a function of determining that the change in pressure satisfies the threshold, the location of the fluid leak.

In an example implementation, a leak detection system includes one or more hardware processors and a computer storage medium communicatively coupled to the one or more hardware processors. The computer storage medium includes instructions that, when executed by the one or more hardware processors, cause the one or more hardware processors to perform operations including receiving, from one or more sensors, sensor feedback including at least one of pressure information or temperature information of an annulus defined between an outer surface of a wellbore string and a wall of the wellbore. The operations also include determining, as a function of the sensor feedback, a location of a fluid leak within the annulus.

In an example implementation combinable with any other example implementation, the system further including a microbead including the one or more sensors. The microbead includes a microchip electrically coupled to the one or more sensors. The receiving the sensor feedback includes receiving, from the microchip, pressure information of the annulus and temperature information of the annulus gathered by the one or more sensors as the microchips falls within the annulus.

What is claimed is:

1. A method, comprising:

selecting, as a function of a density of an annulus fluid disposed within an annulus that is defined between a wellbore string and a wall of a wellbore, a number of weights to be positioned within a weight compartment of a microbead to adjust a weight of the microbead to allow the microbead to descend along the annulus at a predetermined speed;

adjusting, as a function of a density of the fluid, a weight of the microbead to allow the microbead to descend along the annulus at a speed of between 5 and 15 meters per second;

deploying the microbead into the annulus, the microbead comprising one or more sensors comprising a pressure sensor and a temperature sensor disposed within a housing of the microbead, the microbead further comprising a microchip electrically coupled to the pressure sensor and temperature sensor;

receiving, from the one or more sensors, sensor feedback comprising at least one of pressure information or temperature information of the annulus, the receiving comprising receiving, from the microchip, pressure information and temperature information gathered by the pressure sensor and temperature sensor;

determining, as a function of the sensor feedback, a location of a fluid leak within the annulus; and controlling, based on the location of the fluid leak, at least one of a valve or a pump to regulate a fluid flow within the wellbore.

2. The method of claim 1, further comprising, before determining the location of the fluid leak:

determining a change in pressure of the fluid;

determining a location of the change in pressure of the fluid; and comparing the change in pressure to a threshold;

wherein determining the location of the fluid leak comprises determining, as a function of determining that the change in pressure satisfies the threshold, the location of the fluid leak.

3. The method of claim 2, wherein the receiving comprises receiving pressure values associated with timestamps, and determining the location of the change in pressure comprises determining, as a function of (i) a time at which the one or more sensors were deployed, (ii) a falling speed of the one or more sensors, and (iii) the timestamps, a depth of the change in pressure.

4. The method of claim 1, wherein deploying the one or more sensors comprises delivering the one or more sensors into the annulus through a lubricator residing at a terranean surface of the wellbore.

5. The method of claim 4, wherein the lubricator is part of a wellhead fluidly coupled to the wellbore string, the lubricator coupled to at least one of a tubing head spool or a casing spool of the wellhead.

6. The method of claim 1, wherein the determining comprises determining, by the microchip, as a function of the sensor feedback, a falling speed of the microbead, and a time of deployment, the location of the fluid leak.

7. The method of claim 1, wherein the microbead further comprises a memory configured to store a log of pressure values and temperature values at different timestamps along the wellbore as the microbead falls within the annulus, and the determining comprises determining, as a function of the pressure values and temperature values, the location of the fluid leak.

8. The method of claim 1, wherein the receiving comprises continuously receiving pressure information or temperature information from the microchip as the microbead travels within an annulus fluid along the annuls in a downhole direction.

9. The method of claim 1, wherein receiving the sensor feedback comprises receiving sensor feedback continuously or at time intervals as the one or more sensors descend within the annulus.

10. The method of claim 1, further comprising, before deploying the one or more sensors, pre-installing the one or more sensors within a wellhead, and the deploying comprises deploying the one or more sensors using a lubricator attached to the wellhead.

11. The method of claim 1, wherein the wellbore string comprises an aperture through which fluid leaks into or out of the wellbore string, and determining the location of the fluid leak comprises detect a location of the aperture.

12. A method, comprising:

receiving, by a system comprising one or more computers in one or more locations, sensor feedback from one or more sensors of a microbead, the sensor feedback comprising at least one parameter of an annulus defined between an external surface of a wellbore string and a wall of a wellbore, the parameter gathered while the one or more sensors fall downhole within the annulus, the microbead comprising a number of weights positioned within a weight compartment of a microbead to adjust a weight of the microbead to allow the microbead to descend along the annulus at a predetermined speed, the number of weights selected as a function of a density of an annulus fluid disposed within the annulus to allow the microbead to descend along the annulus at a speed of between 5 and 15 meters per second, the one or more sensors comprising a pressure sensor and a temperature sensor disposed within a housing of the microbead, the microbead further comprising a microchip electrically coupled to the pressure sensor and temperature, the receiving comprising receiving, from the microchip, pressure information and temperature information gathered by the pressure sensor and temperature sensor;

determining, by the system and as a function of (i) the sensor feedback and (ii) a falling speed of the one or more sensors, a location of a fluid leak within the annuls; and controlling, based on the location of the fluid leak, at least one of a valve or a pump to regulate a fluid flow within the wellbore.

13. The method of claim 12, further comprising, after the determining, providing, by the system and to a receiver, the location of the fluid leak.

14. The method of claim 12, wherein the determining comprises:

comparing, by the system, the parameter to at least one threshold;

determining, by the system and as a function of the comparison, that the parameter satisfies the at least one threshold.

15. The method of claim 12, further comprising, before determining the location of the fluid leak:

determining a change in pressure of the fluid;

determining a location of the change in pressure of the fluid; and comparing the change in pressure to a threshold;

wherein determining the location of the fluid leak comprises determining, as a function of determining that the change in pressure satisfies the threshold, the location of the fluid leak.

16. A system, comprising:

one or more hardware processors; and a computer storage medium communicatively coupled to the one or more hardware processors, the computer storage medium comprising instructions that, when executed by the one or more hardware processors, cause the one or more hardware processors to perform operations comprising:

receiving, from one or more sensors of a microbead, sensor feedback comprising at least one of pressure information or temperature information of an annulus defined between an outer surface of a wellbore string and a wall of the wellbore, the microbead comprising a number of weights positioned within a weight compartment of a microbead to adjust a weight of the microbead to allow the microbead to descend along the annulus at a predetermined speed, the number of weights selected as a function of a density of an annulus fluid disposed within the annulus to allow the microbead to descend along the annulus at a speed of between 5 and 15 meters per second, the one or more sensors comprising a pressure sensor and a temperature sensor disposed within a housing of the microbead, the microbead further comprising a microchip electrically coupled to the pressure sensor and temperature, the receiving comprising receiving, from the microchip, pressure information and temperature information gathered by the pressure sensor and temperature sensor;

determining, as a function of the sensor feedback, a location of a fluid leak within the annulus; and controlling, based on the location of the fluid leak, at least one of a valve or a pump to regulate a fluid flow within the wellbore.

17. The system of claim 16, wherein the receiving the sensor feedback comprises receiving, from the microchip, the pressure information of the annulus and temperature information of the annulus gathered by the one or more sensors as the microchips falls within the annulus.

18. A method, comprising:

selecting, as a function of a density of an annulus fluid disposed within an annulus that is defined between a wellbore string an a wall of a wellbore, a number of weights to be positioned within a weight compartment of a microbead to adjust a weight of the microbead to allow the microbead to descend along the annulus at a predetermined speed;

adjusting, as a function of a density of the fluid, a weight of the microbead to allow the microbead to descend along the annulus at a predetermined speed;

deploying the microbead into the annulus, the microbead comprising one or more sensors comprising a pressure sensor and a temperature sensor disposed within a housing of the microbead, the microbead further comprising a microchip electrically coupled to the pressure sensor and temperature sensor, the deploying comprising inserting the microbead through a lubricator residing at a terranean surface of the wellbore, and then dropping the microbead into the annulus;

receiving, from the one or more sensors, sensor feedback comprising at least one of pressure information or temperature information of the annulus, the receiving comprising receiving, from the microchip, pressure information and temperature information gathered by the pressure sensor and temperature sensor; and determining, as a function of the sensor feedback, a location of a fluid leak within the annulus.

19. The method of claim 18, further comprising controlling, based on the location of the fluid leak, at least one of a valve or a pump to regulate a fluid flow within the wellbore.

20. The method of claim 18, wherein the lubricator is part of a wellhead fluidly coupled to the wellbore string, the lubricator coupled to at least one of a tubing head spool or a casing spool of the wellhead, and the deploying comprises inserting the microbead through the lubricator until the microbead reaches the annulus, and then dropping the microbead into the annulus.

* * * * *